US006559747B2

(12) United States Patent
Shimoide et al.

(10) Patent No.: US 6,559,747 B2
(45) **Date of Patent: *May 6, 2003**

(54) IGNITION COIL

(75) Inventors: Yoshihiro Shimoide, Tokai (JP); Kazuhide Kawai, Kariya (JP)

(73) Assignee: Denso Corporation, Aichi-pref. (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/459,643

(22) Filed: Dec. 13, 1999

(65) Prior Publication Data

US 2002/0171523 A1 Nov. 21, 2002

(30) Foreign Application Priority Data

Jan. 11, 1999 (JP) ..... 11-003575

(51) Int. Cl.[7] ..... H01E 27/02

(52) U.S. Cl. ..... 336/96; 200/107; 200/192; 123/634

(58) Field of Search ..... 336/96, 107, 192, 336/198, 90, 92; 123/634, 635

(56) References Cited

U.S. PATENT DOCUMENTS 4,035,751 A * 7/1977 Walthew ..... 336/60
5,416,459 A 5/1995 Ida et al.
5,632,259 A * 5/1997 Konda et al. ..... 123/634
5,706,792 A * 1/1998 Boyer et al. ..... 123/634
5,929,736 A * 7/1999 Sakamaki et al. ..... 336/96
5,949,319 A * 9/1999 Nuebel et al. ..... 336/96
5,977,856 A * 11/1999 Maekawa et al. ..... 336/96
6,196,209 B1 * 3/2001 Shimada et al. ..... 123/634
6,208,231 B1 * 3/2001 Oosuka et al. ..... 336/107
6,213,109 B1 * 4/2001 Satoo et al. ..... 123/634
6,252,482 B1 * 6/2001 Chiba et al. ..... 336/96

FOREIGN PATENT DOCUMENTS

EP 0859383 A2 8/1998

* cited by examiner

*Primary Examiner*—Elvin Enad
*Assistant Examiner*—Kyung Lee
(74) *Attorney, Agent, or Firm*—Nixon & Vanderhye PC

(57) ABSTRACT

In order to prevent a crack of plastic parts caused by a shrinkage force of a resin filler filled in an ignition coil casing, a cylindrical coil casing houses a primary coil and a secondary coil concentrically, and the resin filler such as epoxy resin is filled in the coil casing to insulate between the parts in the coil casing and to fix the parts. A ring-shaped partition member is provided at the upper portion in the coil casing to separate the resin filler locating above the primary coil and the secondary coil inside and outside. The partition member is made of a resin whose adhesive strength against the resin filler is weak, such as polypropylene (PP). The partition member reduces the shrinkage force between the outside resin filler and the inside resin filler, and prevents a crack of plastic parts, such as the secondary spool.

28 Claims, 3 Drawing Sheets

IGNITION COIL

CROSS REFERENCE TO RELATED APPLICATION

This application is based upon and claims priority from Japanese patent application No. Hei 11-3575, filed Jan. 11, 1999, the entire contents of which are incorporated herein by reference.

BACKGROUND OF THE INVENTION

1. Field of the Invention

The present invention relates to an ignition coil, such as a stick-type ignition coil, which is installed in a plug hole for each cylinder of an engine.

2. Description of Related Art

One type of known stick-type ignition coil is filled with epoxy resin to insulate and fix a primary winding, a secondary winding and a cylindrical core disposed in a cylindrical coil casing.

The epoxy resin to be filled in the coil casing shrinks when it is hardened after filling. Accordingly, a stress caused by the hardening and shrinkage of the epoxy resin is applied to the plastic parts in the coil casing such as a secondary spool, and the stress remains as it is. Furthermore, the stress applied to the plastic parts may be increased when the epoxy resin is cooled and shrinks after the engine stops if the ignition coil is mounted on the engine. Accordingly, a crack on the plastic parts may be caused by the shrinkage of the epoxy resin, and such crack may decrease the insulation performance.

Especially, an outside dimension of a stick-type ignition coil is regulated by an inside dimension of a plug hole. Thus, the plastic spool has a reduced thickness to obtain a winding space for the coil. Accordingly, mechanical strength of the spool is relatively weak, and an allowable stress of the spool against the shrinkage of the epoxy resin is relatively small. Therefore, it is necessary to reduce the shrinkage force of the epoxy resin applied to the spool in order to prevent the crack of the spool.

Further, the shrinkage force of the epoxy resin applied to the secondary spool locating inner than the primary spool tends to be greater than that applied to the primary spool. Accordingly, the crack is likely to be generated on the secondary spool.

SUMMARY OF THE INVENTION

The present invention is made in light of the foregoing problem, and it is an object of the present invention to provide an ignition coil which prevents a crack of a part of the ignition coil caused by a shrinkage force of filling resin and which improves the insulation reliability.

According to an ignition coil of the present invention, the ignition coil includes a partition member provided in an upper portion of a coil casing for dividing a resin filler locating above a primary coil and a secondary coil into an inside and an outside. Accordingly, the partition member reduces the shrinkage force between the outside resin filler and the inside resin filler. Thus, stress of plastic parts caused by the shrinkage force is reduced, and a crack of the plastic parts is prevented, and the insulating reliability is improved.

According to another aspect of the present invention, if the partition member is made of made of a material whose adhesive strength against the resin filler is substantially weak such that each of the resin filler and the partition member is capable of expanding and shrinking independently. Accordingly, the resin filler is easily peeled from the partition member when the resin filler shrinks or expands, thereby reduces stress applied to the plastic parts.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

DETAILED DESCRIPTION OF PREFERRED EMBODIMENTS

Embodiments of the present invention will be described hereinafter with reference to the drawings.

(First Embodiment)

Figure 1:
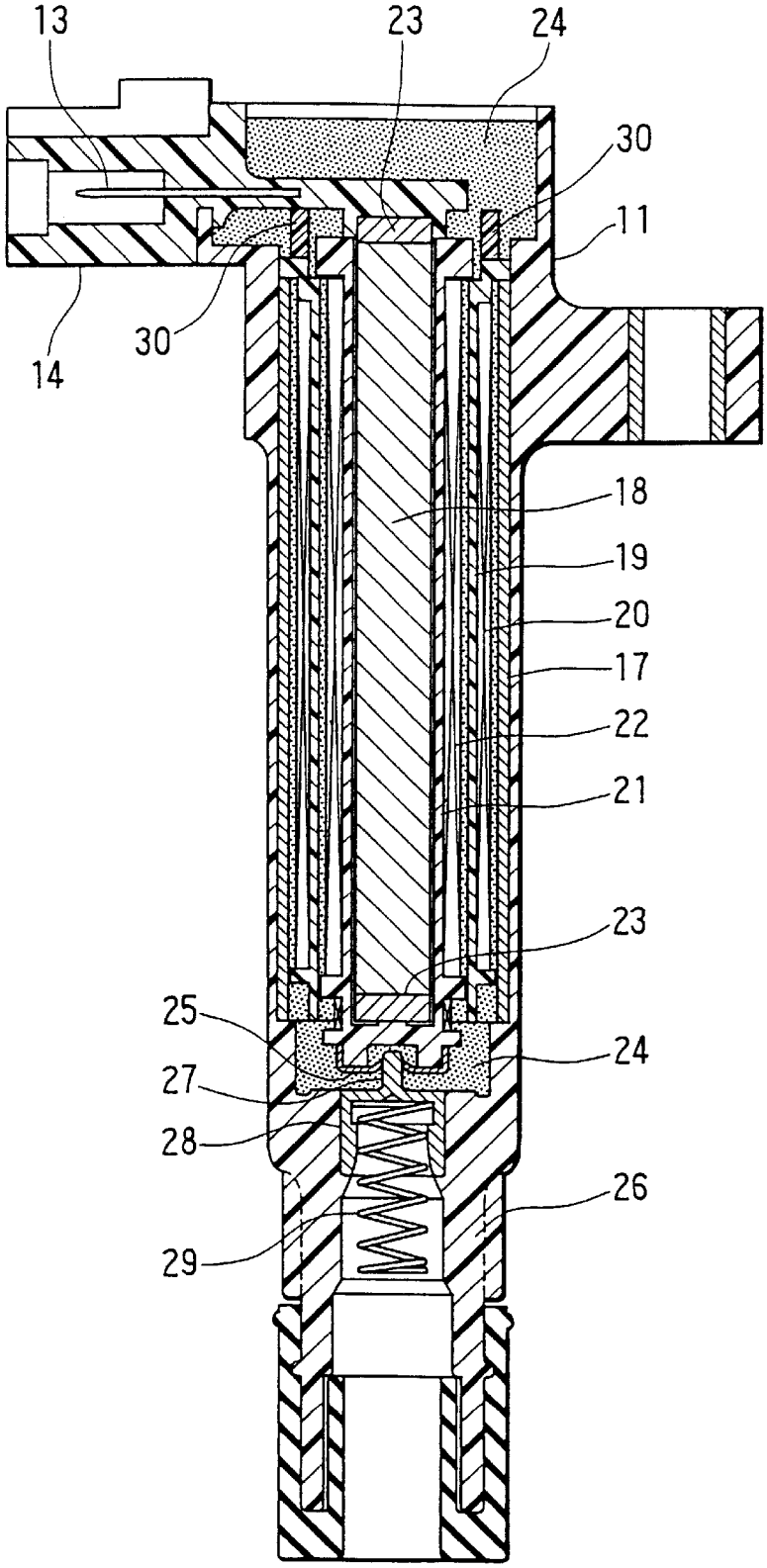
FIG. 1 is a longitudinal sectional view of an ignition coil according to a first embodiment of the present invention.
Figure 2:
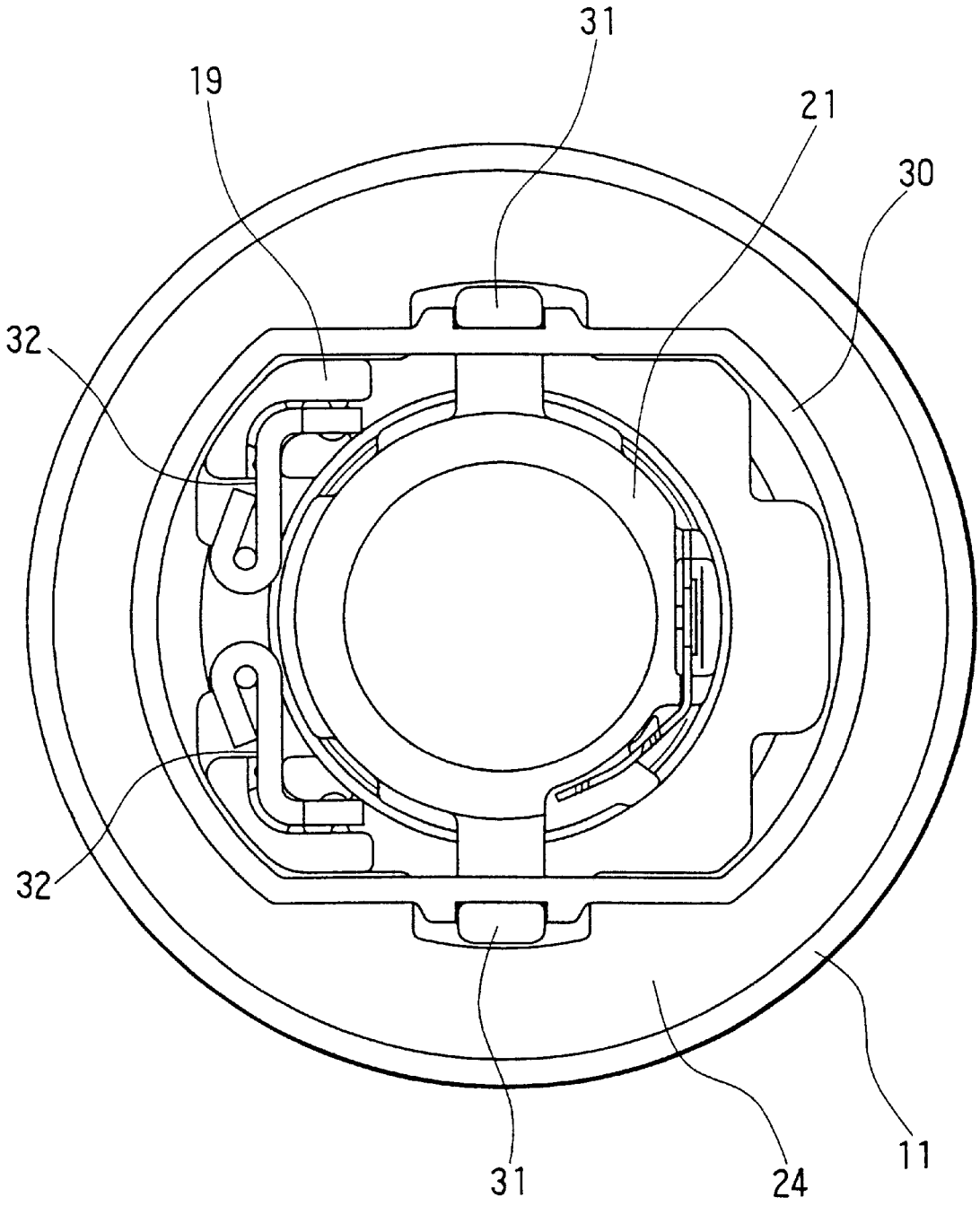
FIG. 2 is an enlarged top plan view of the ignition coil according to the first embodiment of the present invention.

A first embodiment of the present invention is shown in FIGS. 1 and 2.

A cylindrical coil casing 11 is made of insulating resin. A connector pin 13 is inserted in and molded with a connector housing 14. The connector housing 14 is mounted on an upper end of the coil casing 11 by press fitting. A cylindrical central core 18 and a cylindrical outer core 17 are concentrically housed in the coil casing 11.

A primary coil 20, wound around a cylindrical primary spool 19 made of an insulating resin, is housed inside the cylindrical outer core 17. A secondary coil 22, wound around a cylindrical secondary spool 21 made of an insulating resin, is housed inside the primary spool 19. A terminal plate 25 is attached to the bottom end of the secondary spool 21. one end of the secondary coil 22 is connected to the terminal plate 25.

The central core 18 is housed in the secondary spool 21 having a bottom wall. A pair of cushions 23 are disposed at the top and bottom ends of the central core 18. The cushion 23 is a cushioning material to prevent the central core 18 from excessive stress, and is made of a heat resistance elastic material such as a sponge and an elastomer which also prevent magneto striction. Furthermore, thermosetting resin, such as an epoxy resin, is filled in the coil casing 11 by vacuum filling as an insulating resin filler 24.

A high voltage tower portion 26 is unitarily formed with a lower end of the coil casing 11. A terminal cup 28 is unitarily formed with a high voltage terminal 27 by placing the high voltage terminal 27 upwardly. At the center of the top portion of the high voltage tower portion 26, the terminal cup 28 is inserted and molded or press fitted such that the high voltage terminal 27 contacts the terminal plate 25 to maintain the electricity conducting state. When the high voltage tower portion 26 is inserted in an ignition plug hole (not shown) and is press fitted in an upper portion of a spark plug (not shown), a conductive spring 29 latched in the terminal cup 28 contacts a terminal of the spark plug. Accordingly, one end of the secondary coil 22 is electrically connected to the terminal of the spark plug via the terminal plate 25, high voltage terminal 27, terminal cup 28 and spring 29.

A main feature of the first embodiment of the present invention is to provide a partition member 30 to separate the inner side from the outer side of the resin filler 24 filled above the primary coil 20 and the secondary coil 22. The partition member 30 is formed in a ring shape and is made of a resin whose adhesive strength against the resin filler 24 (epoxy resin) is weak, such as polypropylene (PP), polyphenylene sulfide (PPS) and polybutylene terephtalate (PBT).

Instead of using such resin, silicon tape and the like, whose adhesive strength against the resin filler 24 is weak, may be attached on the surface of the partition member 30. Alternatively, the surface of the partition member 30 may be coated to decrease the adhesive strength against the resin filler 24.

The upper portion of the coil casing 11 defines an upper opening of the coil casing that is radially larger than the coils, the partition member and the spools. Thus, as illustrated in FIG. 1, the upper portion of the coil casing defines a receptacle that is radially larger than the portion of the coil casing in which the primary and secondary coils are housed and the receptacle is filled with the insulating resin filler 24. In the illustrated embodiment, the insulating resin filler is filled in the upper portion of the coil casing to a predetermined height from the upper end of the spools and defines a larger radial thickness than other parts of the insulating resin filler filled in the coil casing.

As shown in FIG. 2, the partition member 30 is latched and held by a pair of joints 31 unitarily formed with the upper end portion of the secondary spool 21, and the resin filler 24 is filled under such condition. The primary spool 19, a terminal 32 of the primary coil 20, and the secondary spool 21 are provided inside the partition member 30. As illustrated in FIG. 1, the predetermined height to which the insulating filler resin is filled in the upper portion of the coil casing is higher than the partition member 30.

Generally, a shrinkage force of the resin filler filled in the coil casing becomes greater when the thickness of the resin filler increases. Inside the coil casing, the thickest portion of the resin filler is locating above the first and secondary coils. Accordingly, the shrinkage force of the resin filler becomes greater at the upper portion of the coil casing. According to the first embodiment of the present invention, since the ring-shaped partition member 30 is provided in the upper portion of the coil casing 11, the partition member 30 divides the resin filler 24 at the top portion in the coil casing 11 between the inside and the outside, thereby preventing the shrinking influence of the outside resin filler 24, and thereby reducing the shrinkage force of the inside resin filler 24. Furthermore, since the partition member 30 is made of the resin whose adhesive strength is weak against the resin filler 24, the resin filler 24 is apt to peel from the partition member 30 because of the shrinkage force of the resin filler 24. Accordingly, the shrinkage force of the resin filler 24 outside the partition member 30 is effectively released, and the shrinkage force of the resin filler 24 inside the partition member 30 is effectively reduced. Thus, the stress, applied to plastic parts such as the primary spool 19 and the secondary spool 21 located inside the partition member 30, is effectively reduced, and a crack of the plastic parts is prevented, and the insulation reliability is improved.

Furthermore, since the partition member 30 is an independent part, the partition member 30 is formed by cheap resin whose adhesive strength against the resin filler 24 is weak. Thus, the crack prevention by the partition member 30 is improved with lower cost.

(Second Embodiment)

Figure 3:
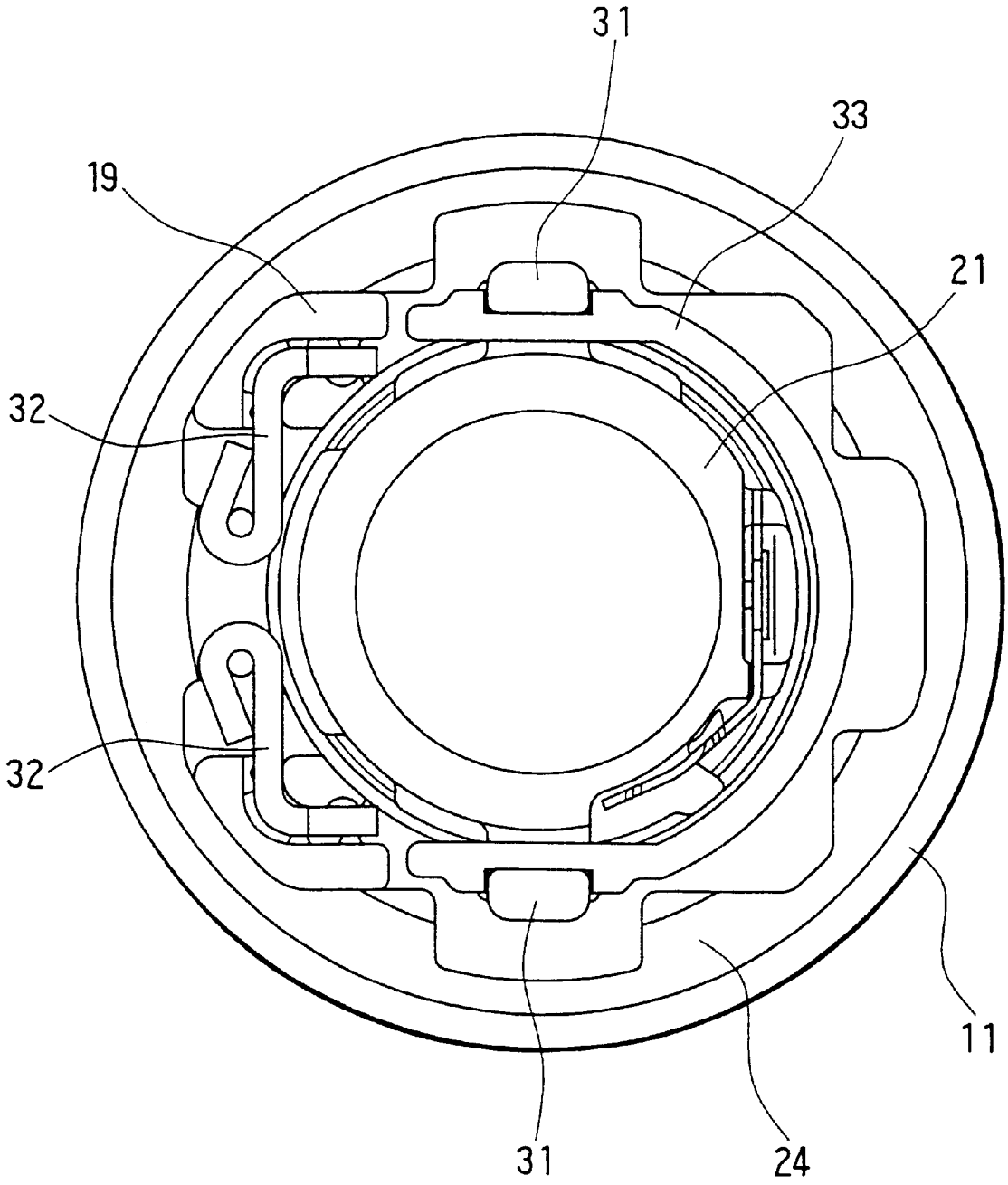
FIG. 3 is an enlarged top plan view of the ignition coil according to a second embodiment of the present invention.

In a second embodiment of the present invention shown in FIG. 3, the present invention is applied to an ignition coil which has a narrower space around the terminal 32. In this embodiment, components which are substantially the same as those in the first embodiment are assigned the same reference numerals.

In the second embodiment, a U-shaped separation member 33 is formed by a resin whose adhesive strength against the resin filler 24 (epoxy resin) is weak such that the separation member 33 and the terminal 32 form a ring-like shape. The partition member 33 is latched and held by a pair of joints 31 unitarily formed with the upper end portion of the secondary spool 21, and the resin filler 24 is filled under such condition. Other structures are the same as those in the first embodiment.

According to the second embodiment of the present invention, the terminal 32 as well as the partition member 33 divides the resin filler 24 into inside and outside. Accordingly, the similar effect described in the first embodiment is obtained even if there is no space for the separation member 33 around the terminal 32.

Although each of the partition members 30 and 33 is an independent part in the first and second embodiments, they may be unitarily formed with other plastic parts such as the connector housing 14. Further, the partition member maybe formed in a shape other than the ring shape.

Furthermore, various modifications, such as providing an igniter above the partition member 30 or 33, are applicable to the present invention.

Although the present invention has been described in connection with the preferred embodiments thereof with reference to the accompanying drawings, it is to be noted that various changes and modifications will be apparent to those skilled in the art. Such changes and modifications are to be understood as being included within the scope of the present invention as defined in the appended claims.

What is claimed is:

1. An ignition coil comprising:

a pipe-shaped coil casing;

a primary coil housed in said coil casing;

a secondary coil housed in said coil casing and disposed concentrically with said primary coil;

an insulating resin filler filled in said coil casing such that a part of said resin filler locates above said primary coil and said secondary coil and a part of said resin filler enters gaps defined by said primary coil and secondary coil;

a partition member provided in an upper portion of said coil casing for dividing said resin filler located above said primary coil and said secondary coil into radial inside and outside parts; and a spool having a portion where an inner one of said primary and secondary coils is wound, wherein said portion has a smaller diameter than an inside diameter of said partition member, wherein:

said resin filler is made of an epoxy resin; and said partition member includes polypropylene (PP).

2. An ignition coil as in claim 1, wherein said partition member is made of a material having a low adhesion to said resin filler, whereby each of said resin filler and said partition member expand and contract independently.

3. An ignition coil as in claim 1, wherein said partition member is formed in a shape of a ring.

4. An ignition coil as in claim 1, wherein:

the ignition coil includes a terminal for said primary coil at said upper portion of said coil casing; and said partition member and said terminal are disposed to form a ring-like shape.

5. An ignition coil as in claim 1, wherein said partition member is formed as an independent part.

6. An ignition coil as in claim 1, wherein said partition member is made of a material having an adhesion to the resin filler that is substantially weak such that said resin filler is easily peeled from said partition member when the resin filler shrinks or expands.

7. An ignition coil as in claim 1, wherein said partition member reduces stress of a plastic part of one of said primary and secondary coils caused by a shrinkage force of said resin filler.

8. An ignition coil as in claim 1, wherein said spool has an opening on the top, and wherein said opening and said portion of said spool are located under said radially inside part of said resin filler.

9. An ignition coil as in claim 1, further comprising another spool receiving the radially outer one of said primary and secondary coils, and having located outside has an opening which is located under said radial inside part of said resin filler.

10. An ignition coil as in claim 1, wherein said partition member extends at least a half of a circle to define said radially inside part of said resin.

11. An ignition coil comprising:

a pipe-shaped coil casing;

a primary coil housed in said coil casing;

a secondary coil housed in said coil casing and disposed concentrically with said primary coil;

said coil casing including an upper portion defined vertically above said primary coil and said secondary coil;

a partition member disposed in said upper portion of said coil casing;

an insulating resin filler filled in said coil casing and entered into gaps defined by said primary coil and secondary coil, a portion of said insulating resin filler being disposed in said upper portion of said coil casing, said partition member dividing the insulating resin filler disposed in said upper portion into a first resin filler part covering an upper end of an inner one of said primary and secondary coils, and a second resin filler part covering a radial outside area of said first resin filler part, wherein:

said resin filler is made of an epoxy resin; and said partition member includes polypropylene (PP).

12. An ignition coil as in claim 11, wherein said partition member is made of a material having a low adhesion to said resin filler, whereby each of said resin filler and said partition member expand and contract independently.

13. An ignition coil as in claim 6, wherein said partition member is formed in a shape of a ring.

14. An ignition coil as in claim 11, wherein:

the ignition coil includes a terminal for said primary coil at said upper portion of said coil casing; and said partition member and said terminal are disposed to form a ring-like shape.

15. An ignition coil as in claim 11, wherein said partition member and said resin filler are respectively made from materials having low adhesion to each other, whereby the resin filler is easily peeled from said partition member upon expansion or contraction of said resin filler.

16. An ignition coil comprising:

a pipe-shaped coil casing;

a coil assembly housed in the coil casing having a spool on which a coil is wound;

an insulating resin filler filled in the coil casing to submerge the spool of the coil assembly, the insulating resin filler having a part disposed above the spool; and a wall member submerged in the part of the insulating resin filler disposed above the spool, the wall member being disposed close to an upper end of the coil assembly with respect to an axis and being disposed outside of the upper end of the spool with respect to a radius, the wall member extending axially from the upper end of the coil assembly into the part of the insulating resin filler, wherein:

said resin filler is made of an epoxy resin; and said wall member includes polypropylene (PP).

17. An ignition coil as in claim 16, wherein the wall member has a surface from which the insulating resin filler is able to peel easily when the resin filler shrinks or expands.

18. An ignition coil as in claim 16, wherein the wall member is separately formed as an independent part.

19. An ignition coil as in claim 16, wherein the wall member is unitarily formed with a part of the coil assembly.

20. An ignition coil as in claim 16, further comprising a pair of terminals connected to the coil, wherein the partition member surrounds the upper end of the spool with the terminals.

21. An ignition coil comprising:

a pipe-shaped coil casing having a bottom portion adapted to conned to a spark plug and an upper portion at a longitudinal end thereof opposite to the bottom portion;

a primary coil housed in said coil casing;

a secondary coil housed in said coil casing and disposed concentrically with said primary coil;

an insulating resin filler filled in said coil casing such that a part of said resin filler locates above said primary coil and said secondary coil and a part of said resin filler enters gaps defined by said primary coil and secondary coil;

a partition member provided in the upper portion of said coil casing for dividing said resin filler located above said primary coil and said secondary coil into radial inside and outside parts;

a spool having a portion where an inner one of said primary and secondary coils is wound, wherein said portion has a smaller diameter than an inside diameter of said partition member; and another spool receiving the radially outer one of said primary and secondary coils, and having an opening which is located under said radial inside part of said resin filler.

22. The ignition coil according to claim 21, wherein the upper portion of the coil casing defines an upper opening of the coil casing.

23. The ignition coil according to claim 22, wherein the upper opening is a single opening that is radially larger than the coils, the partition member and the spools.

24. The ignition coil according to claim 23, wherein the coil casing further has an electrically conductive member passing through the bottom portion.

25. The ignition coil according to claim 22, wherein the insulating filler resin is filled in the upper portion of the coil casing to a predetermined height from the upper end of the spools, the predetermined height being higher than the partition member and being larger than the radial thickness of the insulating filler resin entered into the gaps.

26. The ignition coil according to claim 21, wherein the upper portion of the coil casing defines a receptacle that is radially larger than a portion of the coil casing in which the primary and secondary coils are housed, the receptacle being filled with the insulating filler resin.

27. The ignition coil according to claim 26, wherein the upper portion of the coil casing has an inner diameter that is larger than an outer diameter of the portion of the coil casing in which the primary and secondary coils are housed.

28. The ignition coil according to claim 27, wherein the insulating resin filler filled in the receptacle defines a larger radial thickness than other parts of the insulating resin filler filled in the coil casing.

* * * * *